US005230276A

United States Patent [19]

Collett

[11] Patent Number: 5,230,276

[45] Date of Patent: Jul. 27, 1993

[54] FLUID-DRIVEN ACTUATOR INCLUDING AN INFLATABLE SAC

[76] Inventor: Robert G. Collett, Old White Horse, High St., Flitton, Bedfordshire MK45 5DY, England

[21] Appl. No.: 908,651

[22] Filed: Jul. 2, 1992

Related U.S. Application Data

[63] Continuation of Ser. No. 823,063, Jan. 14, 1992, abandoned, which is a continuation of Ser. No. 635,609, filed as PCT/GB89/00834, Jul. 20, 1989, abandoned.

[30] Foreign Application Priority Data

Jul. 23, 1988 [GB] United Kingdom ..... 8817623

[51] Int. Cl.[5] ..... F01B 19/00

[52] U.S. Cl. ..... 92/90; 92/89; 92/34; 92/44

[58] Field of Search ..... 92/34, 36, 44, 89, 90, 92/91, 92

[56] References Cited

U.S. PATENT DOCUMENTS

| | | | |
|---|---|---|---|
| 1,986,273 | 1/1935 | Leffingwell | 92/92 |
| 3,413,856 | 12/1968 | Lombardi | 92/92 |
| 3,417,942 | 12/1968 | Van Alstyne | 92/90 |
| 3,784,255 | 1/1974 | Smock | 92/92 |
| 4,582,463 | 4/1986 | Schreiner | 92/34 |
| 4,838,147 | 6/1989 | Grishchenko | 92/89 |

FOREIGN PATENT DOCUMENTS

| | | | |
|---|---|---|---|
| 1137188 | 9/1962 | Fed. Rep. of Germany | 92/34 |
| 578476 | 9/1924 | France | 92/92 |
| 2421294 | 11/1979 | France | 92/90 |
| 541206 | 3/1956 | Italy | 92/34 |
| 3204098 | 9/1923 | United Kingdom | 92/92 |

*Primary Examiner*—Thomas E. Denion

[57] ABSTRACT

A fluid-driven actuator including a barrier having narrow openings, an inflatable sac having two portions, a first portion including working surface external to the barrier means, and a second portion compactly folded behind the barrier means, and a movable member positioned for engagement by the working surface of the sac and moved when the sac is inflated and the second portion of the sac is drawn through the narrow openings in the barrier means.

9 Claims, 3 Drawing Sheets

FLUID-DRIVEN ACTUATOR INCLUDING AN INFLATABLE SAC

This is a continuation of application Ser. No. 07/823,063, filed Jan. 14, 1992, now abandoned, which is a continuation of U.S. patent application Ser. No. 07/635,609, filed Mar. 25, 1991, filed as PCT/GB89/00834, Jul. 20, 1989, now abandoned.

BACKGROUND OF THE INVENTION

This invention relates to fluid-driven actuator devices It is particularly but not exclusively intended for use in a system in which one or more packages is to be ejected from a container.

The conversion of fluid pressure and motion to linear displacement by means of a piston or bellows is well known. A piston-based device requires a rigid cylinder within which the piston is caused to move by fluid pressure, and the length of the cylinder must correspond to the displacement or stroke of the piston. If the piston is used to eject a package from a container at a substantial velocity, either the stroke is short, the cylinder is short and the ejection shock relatively high; or the stroke is made longer and the shock is reduced, but appreciable packaging space is lost because a larger rigid cylinder is required. If a device essentially comprising a bellows is used as an ejector, unless the displacement path of the bellows during its extension is defined by some rigid guide such as a surrounding tube, the body of the bellows will tend to distort away from the ideal because the system cannot remain symmetrical and stable.

Another form of actuator may be based on a flexible sac, which may be stored in a deflated state requiring relatively little packaging space, and expanded by inflation to provide the actuation movement. Known devices perform in an unpredictable manner during inflation of the sac. Furthermore, if rapid inflation is required the configuration of the sac is further complicated by transient phenomena associated with fluid flow into the sac and the nature of any external load. When fully inflated, however, the sac will adopt a shape determined either by the walls of the sac or by container into which it has been expanded, or by some combination of the two.

SUMMARY OF THE INVENTION

The object of the invention is to provide an improved actuator.

According to one aspect of the present invention there is provided a fluid-driven actuator comprising an inflatable sac one portion of which is compactly stowed and barrier means for separating the stowed portion from the remainder of the sac, the barrier means defining at least one narrow opening through which the sac moves as it is inflated.

According to another aspect the invention provides an actuator comprising a container which accommodates a sac and includes an inlet port for fluid pressure for the inflation of the sac, and barrier means defining at least one narrow opening through which the sac is guided during inflation.

Preferably the sac is systematically folded.

Two specific embodiments of the invention will now be described by way of example with reference to the accompanying drawings.

DESCRIPTION OF PREFERRED EMBODIMENTS

Figure 1:
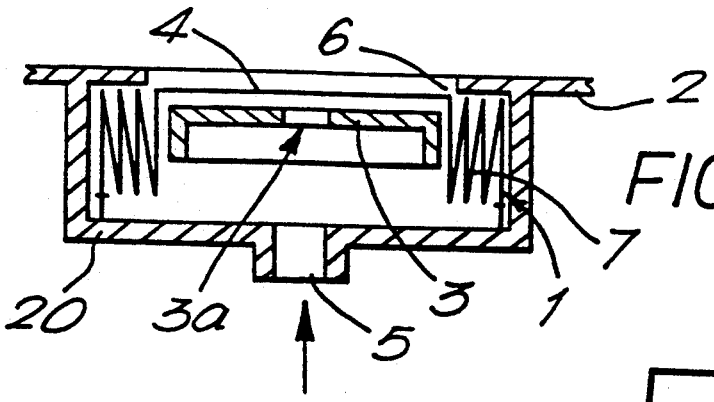
FIG. 1 is a schematic cross-sectional representation of one embodiment of the invention.

Referring to FIG. 1, which is a sectional view of a circular assembly, the fluid-driven actuator comprises a relatively strong sac 1. The sac is generally flexible. Preferably it comprises a systematically folded part 7 and a working part, which is effectively a surface 4 and which may be flexible but could be rigid or partially rigid. The sac is contained behind a bulkhead 2 and located by a guide 3. The guide 3 comprises a flanged disc which has a central aperture 3*a*. The working part of the sac at any time is separated from the folded part by a relatively narrow opening 6. The sac is sealingly secured to a cylindrical container 20, which has an inlet port 5. The guide 3 is supported by means not shown.

When a source of fluid pressure is applied at an inlet port 5 to the container in the direction of the arrow, the working face 4 is forced beyond the bulkhead, and as it moves, it draws the folded portions of the sac through the narrow opening 6 between bulkhead 2 and the guide 3. It will be readily appreciated that in this way, the internal pressure in the sac tends to urge the wall of the sac towards the bulkhead opening, whilst the working section of the sac is maintained fully inflated. Reaction pressures are therefore referred to the bulkhead and the fluid source, whilst the working portion of the sac, being fully inflated has a configuration defined by the container and the sac design.

Figure 2:
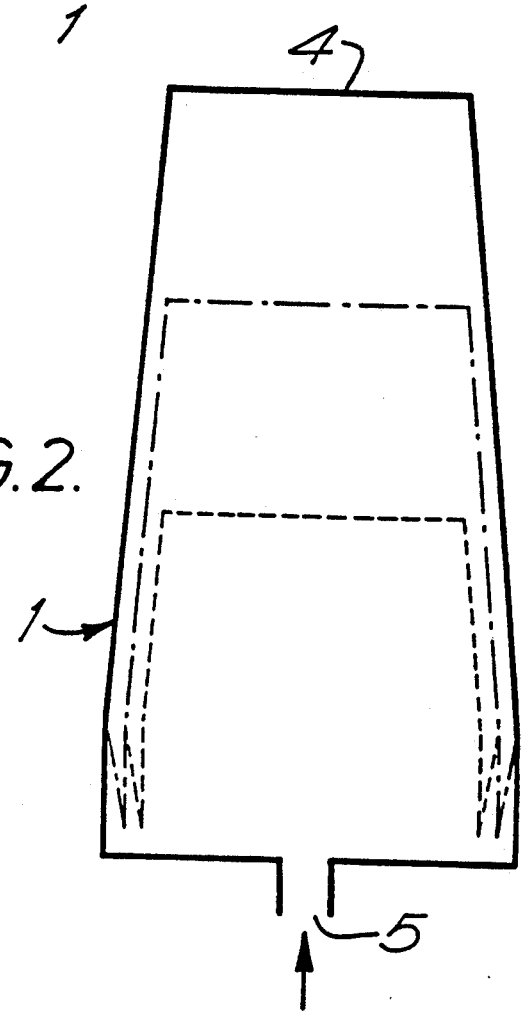
FIG. 2 is a simplified illustration of successive stages in the inflation cycle of the first embodiment of the invention.

FIG. 2 illustrates the way in which a relatively long stroke may be achieved from a compact stored state. In practice, the shape of the sac would be distorted by the restriction imposed by the container.

Figure 3:
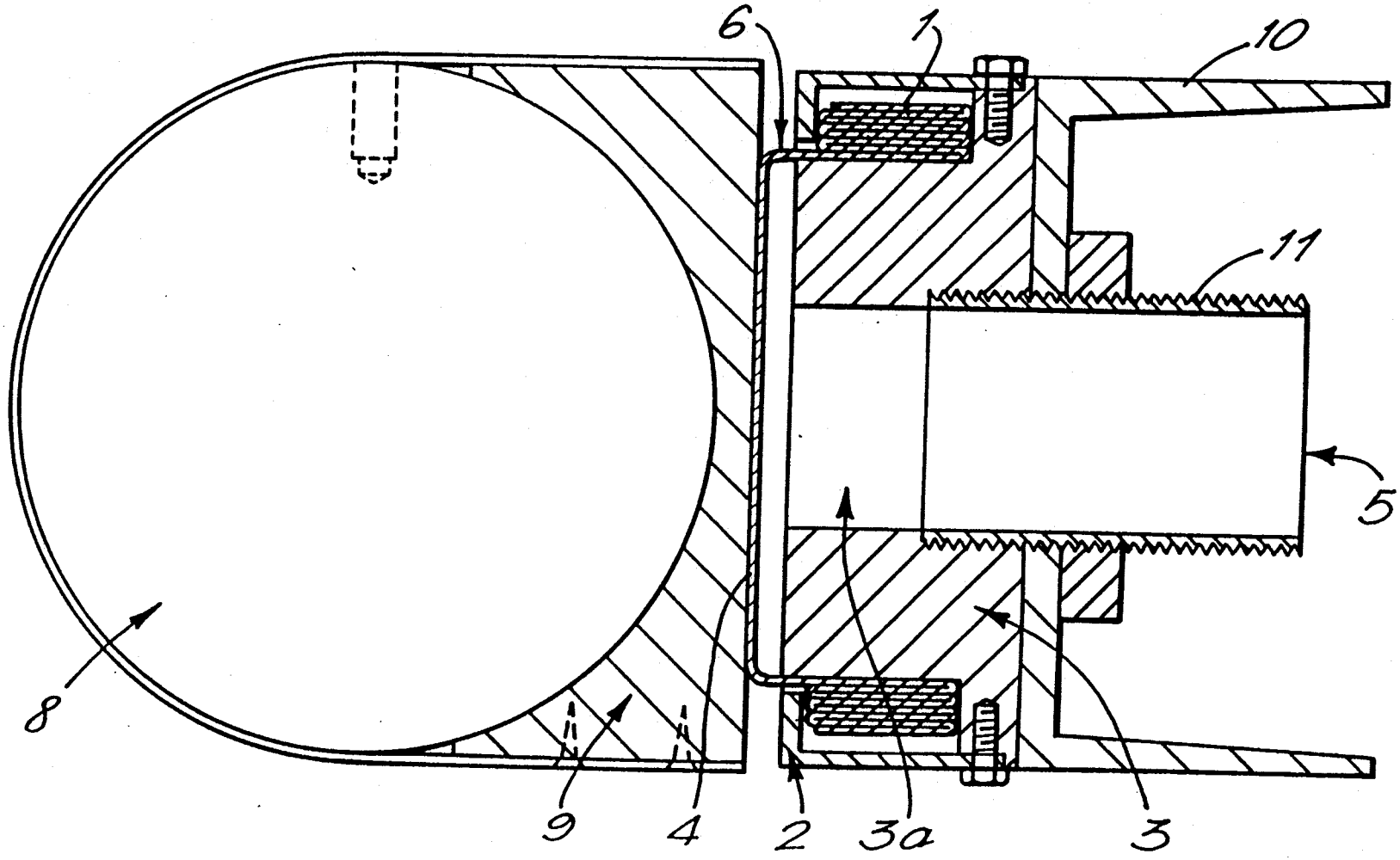
FIG. 3 is a detailed cross-sectional representation of the first embodiment of the invention showing an applied load.

FIG. 3 is a detailed illustration of a particular embodiment according to FIG. 1. This embodiment is used as an ejector for a device 8 supported by a hod 9, which rests on the working face 4 of the sac 1. A fluid inlet fitting 5 fits sealingly into a central aperture 3*a* of a guide 3, and comprises a channel section support 10 and a threaded conduit 11.

From the foregoing, it will be appreciated that although a circular device has been described, cross-sections of alternative shape may be employed, with different methods of folding or otherwise stowing the sac. Similarly, alternative locations for fluid entry may be chosen.

It should also be noted that in these descriptions 'working bulkhead' and 'guide' are relative terms, and a system may be configured in which the 'working face' is effectively stationary, and in which the 'bulkhead' constitutes a container for the folded portion of the sac and is made to move under pressure. A separate guide structure may not be necessary for some configurations.

Although the working face is shown in FIGS. 1 and 2 as a portion of the sac, it may be a separate member which is wholly or partly sealed to the wall or face of the sac.

Figure 4:
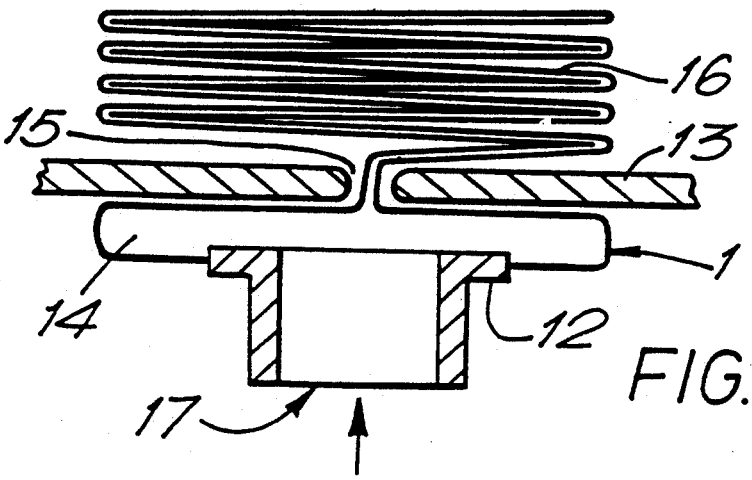
FIG. 4 is a schematic cross-sectional representation of a further embodiment of the invention.

Another embodiment is illustrated schematically in FIG. 4. A strong flexible sac-like container 1 of square or rectangular cross-section is attached at one end to a fixed flange 12. The bulk of the sac 16 is suitably folded into a ribbon form and passes through an aperture formed in a moveable member 13. This is most conveniently an elongate slot 15. The bulk of the sac beyond the slot is further compacted, and stored ready for use, by folding regularly in a zig-zag form, for example.

When a source of fluid pressure is applied at an inlet port 17 as indicated by the arrow, a sac cavity 14 is inflated to apply a moving force to member 13. As this member moves away from the flange 12, the folded sac is withdrawn continuously from the storage compartment through the slot and inflated in such a way as to maintain a force on the member 13. It will be appreciated that the sac-like container is, in fact, a tube, and the folded end need not be sealed.

Figure 5:
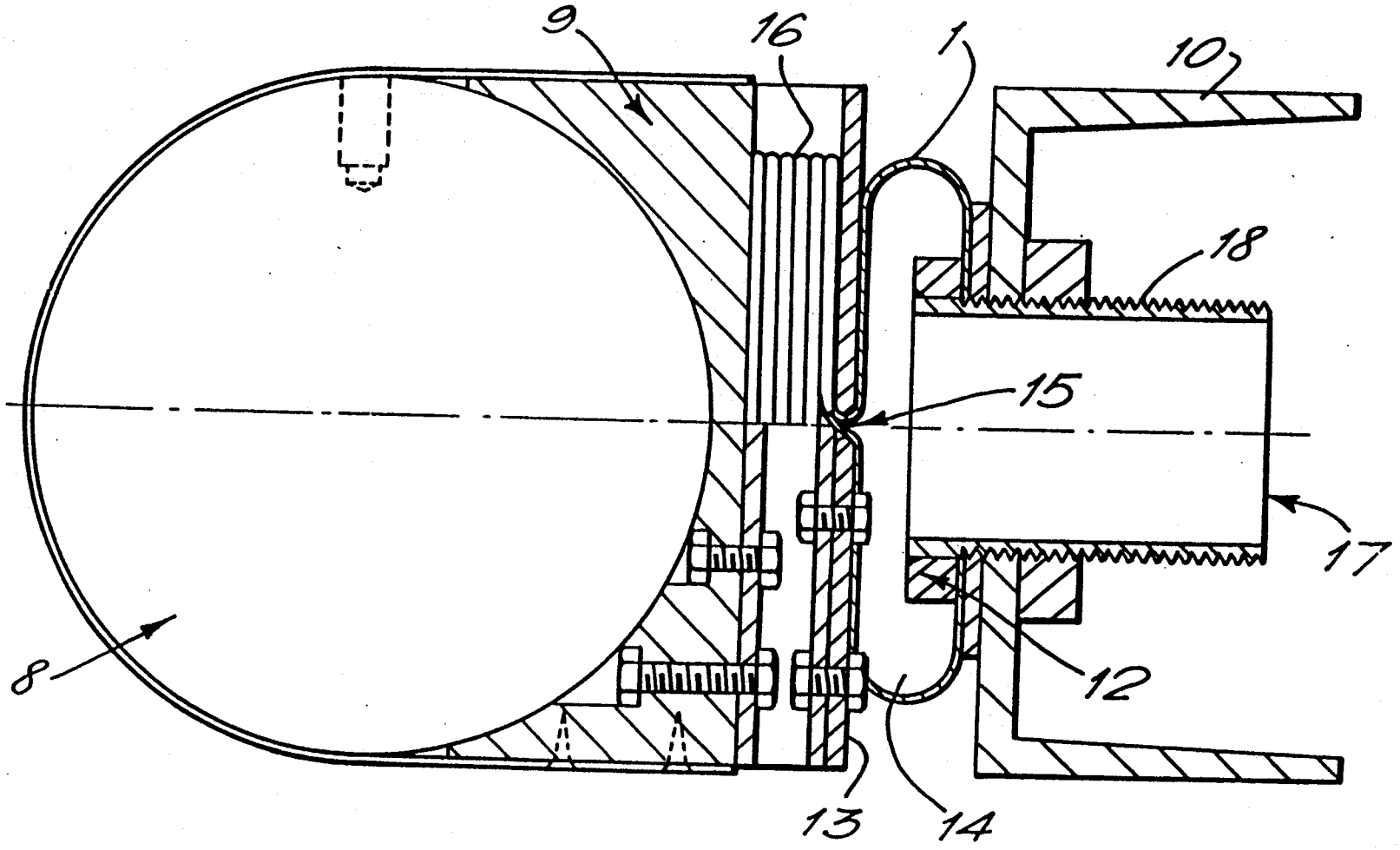
FIG. 5 is a detailed cross-sectional representation of the second embodiment of the invention showing an applied load.

FIG. 5 is a detailed illustration of a particular embodiment of the rectangular assembly according to FIG. 4. This embodiment is used as an ejector for a device 8 supported by a hod 9. The hod is supported on an adjustable gap plate which comprises a moving member 13. A fluid inlet fitting 17 comprises a channel section support 10 and a threaded conduit 18 which has a flange 12. The flange fits sealingly with a sac 1.

The flexible sac in the foregoing description may be constructed from any flexible or acceptably fluid-tight material, provided that the geometry of the sac is sufficiently well defined for its purpose at full working pressures. Rubberised canvas and the like are particularly suitable, whilst other plastics and ductile metals, singly or in combination, are practicable to satisfy the wide range of dimensions, pressures, cross-sectional forms, and applications for which this invention is suitable.

I claim:

1. A fluid-driven actuator comprising an inflatable sac having a first portion and a second portion, said first portion including an external working surface and said second portion being in a compactly folded configuration, and rigid barrier means including at least one narrow opening separating the said first portion from the said second portion of the sac, a movable member including said rigid barrier means positioned for engagement by said working surface of the sac whereby said movable member is moved by the inflation of the sac, and means for coupling fluid pressure to the interior of said first portion of the sac whereby to inflate said sac, said second portion of the sac being drawn through said narrow opening as said sac is inflated.

2. A fluid driven actuator comprising:

an inflatable sac having a first portion for providing a working surface and a second, stowed portion;

a container which contains the said second portion of said sac and includes fluid pressure inlet means for communicating fluid pressure to the interior of said sac;

a bulkhead forming part of said container;

guide means defining with said bulkhead a narrow opening separating said first and second portions of said sac and defining the working surface thereof and allowing said first portion of the sac to draw the second portion of the sac through the opening as the sac is inflated;

a movable member positioned to be engaged by said working surface and to be moved by said working surface;

said guide means including said fluid pressure inlet means and said guide means disposed inside said sac.

3. An actuator according to claim 2 wherein said member comprises a hod supporting a device for ejection.

4. A fluid-driven actuator comprising:

an inflatable sac having a first portion for providing a working surface and a second portion;

a support for said first portion of the sac, said support including a fluid pressure inlet for communicating fluid pressure to the interior of said first portion of said sac to cause inflating thereof; and a member movable relative to said support, said movable member including a bulkhead for engagement by said working surface of the support, said bulkhead including a narrow opening separating said first portion of the sac from said second portion and defining the working surface of the sac, the inflation of said sac causing said working surface to engage said bulkhead and move said member away from said support and to draw said second portion through said narrow opening.

5. An actuator according to claim 4 wherein said first portion of said sac is sealed to said support.

6. An actuator according to claim 4 wherein said member comprises a hod supporting a device for ejection, said hod being spaced from the bulkhead and said second portion of the sac being disposed between the bulkhead and the hod.

7. An actuator according to claim 6 wherein said second portion is folded.

8. A fluid-driven actuator comprising:

an inflatable sac having a first portion for providing a working surface and a second portion;

a support for said first portion of the sac, said support including a fluid pressure inlet for communicating fluid pressure to the interior of said first portion of said sac to cause inflation thereof; and a member movable relative to said support, said movable member including:

a bulkhead for engagement by said working surface of the support, said bulkhead defining the working surface of the sac and including a narrow opening separating said first portion of the sac from said second portion, the inflation of aid sac causing said working to engage said bulkhead and move said member away from said support and to draw said second portion through said narrow opening, a device for ejection, and a hod supporting said device for ejection, said hod being spaced from the bulkhead and said second portion of the sac being disposed between the bulkhead and the hod.

9. An actuator according to claim 8 wherein said second portion of said sac is folded compactly.

* * * * *